US011536266B2

(12) United States Patent
Zaki et al.

(10) Patent No.: US 11,536,266 B2
(45) Date of Patent: Dec. 27, 2022

(54) MODULAR BLOCK FOR ELECTRIC PUMP WITH LIMITED SPACE REQUIREMENT AND ASSOCIATED PUMP

(71) Applicant: EXEL INDUSTRIES, Epernay (FR)

(72) Inventors: Mazen Zaki, Éragny sur Oise (FR); Benoît Batllo, Paris (FR); Boussif Khaldi, Arnouville lès Gonesse (FR); Philippe De Talhouet, Paris (FR); Frederic Vazeille, Charny Orée de Puisaye (FR)

(73) Assignee: EXEL INDUSTRIES, Epernay (FR)

( * ) Notice: Subject to any disclaimer, the term of this patent is extended or adjusted under 35 U.S.C. 154(b) by 65 days.

(21) Appl. No.: 16/985,172

(22) Filed: Aug. 4, 2020

(65) Prior Publication Data

US 2021/0040941 A1 Feb. 11, 2021

(30) Foreign Application Priority Data

Aug. 6, 2019 (FR) ..... 1909022

(51) Int. Cl.
*F04B 53/16* (2006.01)
*F04B 43/04* (2006.01)
(Continued)

(52) U.S. Cl.
CPC ..... *F04B 53/16* (2013.01); *F04B 17/03* (2013.01); *F04B 43/04* (2013.01); *F04B 15/02* (2013.01)

(58) Field of Classification Search
CPC ..... F04B 1/053; F04B 1/0536; F04B 1/0538; F04B 15/02; F04B 1/02; F04B 53/00; F04B 53/16; F04B 53/162; F04B 53/22
(Continued)

(56) References Cited

U.S. PATENT DOCUMENTS 2,255,852 A * 9/1941 Lundin ..... F04B 1/053 123/54.2
5,634,777 A * 6/1997 Albertin ..... F04B 1/0538 417/273
(Continued)

FOREIGN PATENT DOCUMENTS

DE 19536696 A1 4/1997
FR 2503272 A1 10/1982
(Continued)

OTHER PUBLICATIONS

Author: SKF Title: Multi-line pumps Date published (mm/yyyy): Aug. 2015 Date accessed (dd/mm/yyyy): Aug. 5, 2022 Link: https://www.skf.com/binaries/pub12/Images/0901d1968018e3ad-1-3000-EN_tcm_12-60480.pdf#cid-60480 (Year: 2015).*
(Continued)

*Primary Examiner* — Charles G Freay
*Assistant Examiner* — Chirag Jariwala
(74) *Attorney, Agent, or Firm* — Soquel Group LLC

(57) ABSTRACT

A modular block for an electric pump for a fluid product, including a main body defining a housing extending along a main axis, the main body having a general shape having a discrete rotational symmetry relative to a reversion axis, the main axis of the housing within the housing extending on a first side of a central plane outside the central plane, the reversion axis being included in the central plane, and a pumping device extending at least partially in the housing of the main body.

13 Claims, 6 Drawing Sheets

(51) Int. Cl.
*F04B 17/03* (2006.01)
*F04B 15/02* (2006.01)

(58) Field of Classification Search
USPC ..... 417/236, 238, 239
See application file for complete search history.

(56) References Cited

U.S. PATENT DOCUMENTS

| | | | | |
|---|---|---|---|---|
| 6,412,454 | B1 * | 7/2002 | Green | F01B 1/062 123/54.1 |
| 10,823,160 | B1 * | 11/2020 | Babcock | F04B 53/10 |
| 2002/0168273 | A1 * | 11/2002 | Olson | F04B 1/04 417/393 |
| 2005/0201880 | A1 * | 9/2005 | Gentilin | F04B 9/045 417/521 |
| 2014/0199187 | A1 * | 7/2014 | Schedgick | F04B 1/053 417/273 |
| 2018/0087720 | A1 * | 3/2018 | Froehler | F04B 17/03 |
| 2018/0274525 | A1 * | 9/2018 | Schretling | F04B 11/00 |

FOREIGN PATENT DOCUMENTS

| | | | | |
|---|---|---|---|---|
| FR | 3015582 | A1 | 6/2015 | |
| GB | 2564409 | A * | 1/2019 | F01B 1/062 |
| WO | WO-2015147971 | A1 * | 10/2015 | F04B 1/0408 |

OTHER PUBLICATIONS

INPI Rapport de Recherche Préliminaire for Patent Application No. FR 1909022, Apr. 20, 2020, 2 pp.

* cited by examiner

MODULAR BLOCK FOR ELECTRIC PUMP WITH LIMITED SPACE REQUIREMENT AND ASSOCIATED PUMP

CROSS-REFERENCE TO RELATED APPLICATION

This application claims priority of French Patent Application No. 19 09022, filed on Aug. 6, 2019.

FIELD OF THE INVENTION

The present invention relates to a modular block for an electric pump for a fluid product, in particular for paint, and an associated electric pump.

BACKGROUND OF THE INVENTION

"Fluid product" here and hereinafter refers to a product having a viscosity of between 1 mPa·s and 300,000 mPa·s, this viscosity, for example, being measured using a Brookfield Plan Cone viscosimeter under normal temperature and pressure conditions. This expression thus encompasses products in liquid state, perfectly deformable and with a low viscosity, as well as products generally described as "pasty", more viscous than liquids and having a state midway between the liquid state and the solid state.

Such a pump is, for example, suitable for circulating paint in a circuit. In particular, this makes it possible to avoid sedimentation of the paint, and to keep the paint homogeneous.

The pump must be adapted to the desired circulation rate. In particular, if the pump is not adapted to the rate, there is a risk of the pump running too quickly and causing the paint to laminate, or of the pump running too slowly and the paint not being homogeneous.

Furthermore, it is important to provide a constant flow rate and pressure of the fluid product in the vicinity of the user so as to allow a homogeneous distribution of the fluid, for example, during the application of a paint.

It is further desirable to be able to adapt the circulation rate in a circulation assembly according to different flow rate ranges such as 20 liters per minute, 40 liters per minute and 60 liters per minute. It is then necessary to adapt the pump to the change in flow rate.

One possibility consists of having one pump per desired flow rate range and changing pumps upon each change of flow rate. However, this is expensive and requires a large storage area for the pumps that are not in use.

In the context of chemical methods in the cosmetic, petrochemical, pharmaceutical and food industry sectors, electric pumps exist including an electric motor and identical modules that are provided to be combined in order to make it possible to adjust the flow rate and/or to use different products.

The modules are, for example, superimposed along a shaft of the electric motor.

However, such pumps have a significant bulk in the direction of the shaft of the electric motor, due to the superposition of the modules in this direction.

SUMMARY OF THE DESCRIPTION

One aim of the invention is to provide a pump system that is adaptable to different flow rate ranges having a limited bulk.

To that end, the invention relates to a modular block for an electric pump for a fluid product, including:

a main body defining a housing extending along a main axis, the main body having a general shape having a discrete rotational symmetry relative to a reversion axis, the main axis of the housing within the housing extending on a first side of a central plane outside the central plane, the reversion axis being included in the central plane, and a pumping device extending at least partially in the housing of the main body.

The symmetries of the modular block make it possible to superimpose two identical modular blocks such that the second respective planes extend in a same plane and while alternating the location of the housing relative to said plane, and thus of the pumping device. The general space requirement of the modular block depending on the space requirement of the pumping device, the alternating arrangement of the pumping devices offers the possibility of reducing the space requirement of the superposition of modular blocks in the superposition direction.

The modular block may further have one or more of the features below, considered individually or according to any technical possible combination(s):

the main body delimits at least one fluid reservoir, the at least one reservoir being reversible by rotation relative to the reversion axis, the main body includes an intermediate wall, the intermediate wall delimiting two open volumes forming the at least one reservoir, each open volume having a suction orifice and a discharge orifice, the pumping device includes a diaphragm, the diaphragm extending on the first side of the central plane outside the central plane, the pumping device includes a piston, the piston extending at least partially in the housing and being able to slide along the main axis of the housing, general shape of the main body has an orthogonal symmetry relative to the central plane, the main axis extends in a first plane, the first plane being perpendicular to the central plane, the reversion axis being included in the first plane, the main body delimits a through-orifice in a direction perpendicular to the first plane, called elevation direction, the through-orifice having an orthogonal symmetry relative to the first plane ($P_h$) and relative to the central plane, the housing emerging in the through-orifice, the diagram is arranged, or extends, outside the housing away from, or on an opposite side in regard to, the through-orifice along the main axis of the housing, and/or the through-orifice has a central axis along the elevation direction, the intersection between the main axis and the central plane being included in the central axis.

The invention further relates to a modular block for an electric pump including a main body and a pumping device, the main body having a general shape having an orthogonal symmetry relative to a plane, the pumping device being placed outside the plane on one side of the plane, the modular block having a reversibility relative to a reversion axis included in the plane.

The invention further relates to an electric pump for a fluid product including an electric motor and at least two modular blocks as previously defined, the modular blocks being identical and placed side by side such that their general shapes are superimposed in an elevation direction, their respective central planes are combined in a common central plane, the modular blocks being placed such that the main axes are placed alternating on a first side and a second side of the common central plane.

BRIEF DESCRIPTION OF THE DRAWINGS

Other features and advantages of the invention will appear upon reading the following description of embodiments of the invention, solely as an example and done in reference to the drawings, in which.

DETAILED DESCRIPTION

Figure 1:
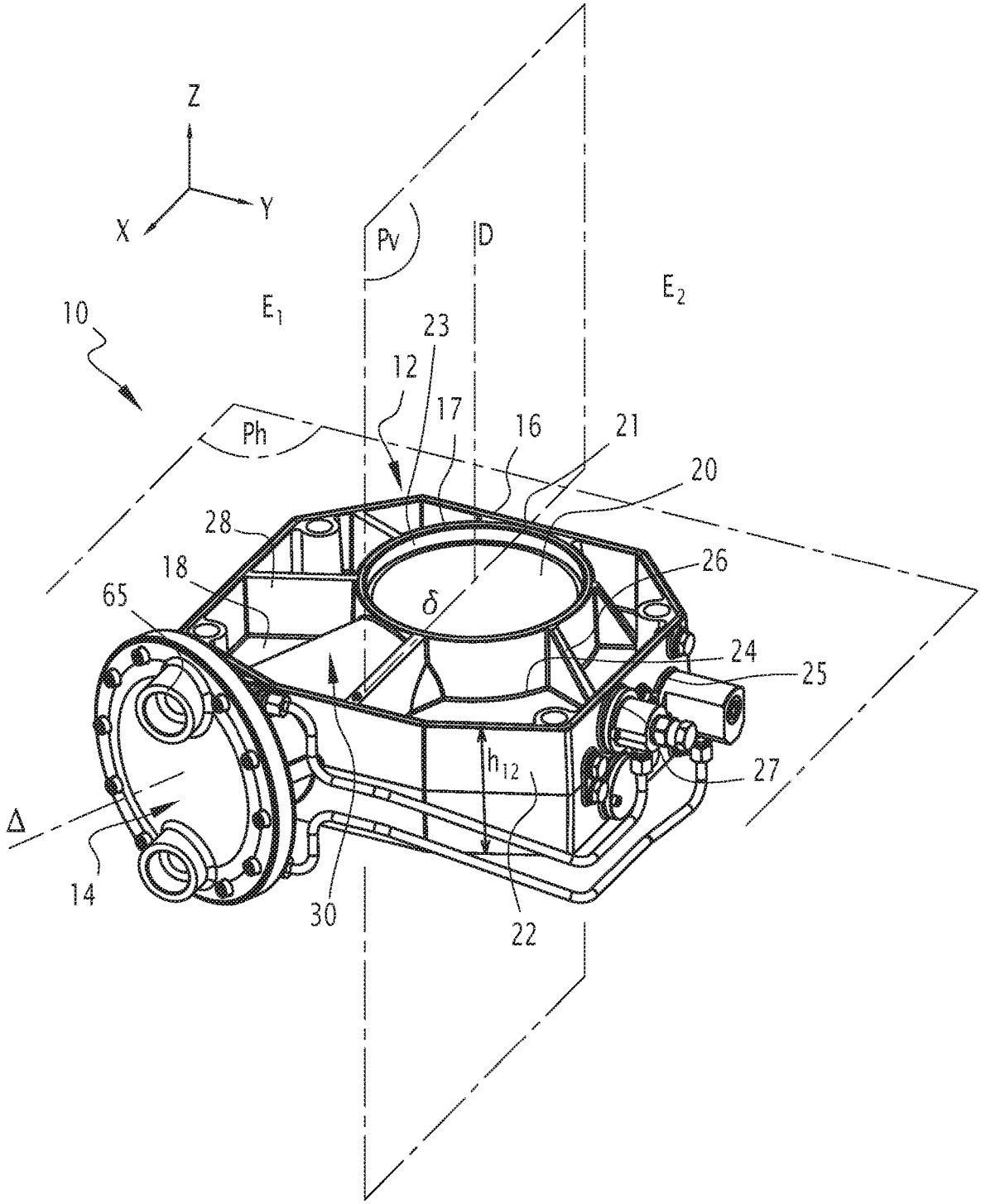
FIG. 1 is a perspective view of a module block according to one embodiment of the invention.

A modular block 10 for an electric pump for a fluid product is shown in FIG. 1 and visible in FIGS. 2 to 6.

Modular block 10 includes a main body 12 and a pumping device 14.

Modular block 10 is provided to cooperate with the shaft of a motor extending in a direction denoted elevation direction Z.

A longitudinal direction X and a transverse direction Y perpendicular to one another and perpendicular to the elevation direction Z are designated, so as to define an orthogonal coordinate system.

Main body 12 includes one, or here, several outer side walls 16.

Main body 12 further includes an inner side wall 17, and here an intermediate wall 18.

Main body 12 has a general shape. The general shape here is defined by outer side wall(s) 16.

Outer side walls 16 here extend in the elevation direction Z.

Outer side walls 16 have a dimension in the elevation direction Z, said dimension being denoted "height", that is constant over all of the walls.

The general shape has a discrete rotational symmetry relative to a reversion axis δ, more specifically for an angle of rotation substantially equal to 180°.

The general shape has an orthogonal symmetry relative to a first plane $P_h$ and relative to a second plane $P_v$.

Second plane $P_v$ is perpendicular to first plane $P_h$.

Reversion axis δ here corresponds to the intersection of first plane $P_h$ and second plane $P_v$.

First plane $P_h$ extends in longitudinal direction X and in transverse direction Y.

Second plane $P_v$ extends in transverse direction Y and in elevation direction Z.

For purposes of the description, we consider that second plane $P_v$ divides the space in two halves with a first side $E_1$ of the second plane and a second side $E_2$ of the second plane. Second plane $P_v$ is also denoted as the central plane.

Inner side wall 17 defines a through-orifice 20 passing through modular block 10.

Through-orifice 20 goes through modular block 10 in elevation direction Z.

Main body 12 is configured to receive the shaft of the motor in through-orifice 20.

Inner side wall 17 has a constant height, more specifically equal to the height of the outer side walls.

Inner side wall 17 is level with outer side walls 16.

Inner side wall 17 is included in the general shape.

Inner side wall 17 is in contact with outer side wall(s) 16 in a location 21 included in second plane $P_v$.

Through-orifice 20 has a central axis D, here extending along elevation direction Z.

Through-orifice 20 has an orthogonal symmetry relative to first plane $P_h$ and relative to second plane $P_v$.

Inner side wall 17 here is a cylinder with a circular base having, for axis of revolution, central axis D of through-orifice 20.

Main body 12, more specifically inner side wall 17, has a bore 23 at each end of through-orifice 20 in elevation direction Z. Bore 23 here extends over the face of inner side wall 17 delimiting through-orifice 20.

Intermediate wall 18 here is a median wall of main body 12, that is to say, it extends at mid-height of main body 12 in elevation direction Z.

Intermediate wall 18 here extends along first plane $P_h$.

Intermediate wall 18 then separates modular block 10 into two halves 22, which here are orthogonally symmetrical.

Modular block 10, more specifically intermediate wall 18, outer side walls 16 and inner side wall 17, delimits an open volume 24 for each half 22. Open volume 24 is open at the side opposite intermediate wall 18 in elevation direction Z.

Each open volume 24 is adaptable to form a fluid reservoir.

In particular, each open volume 24 has a suction opening 25 and a discharge opening 27.

Suction opening 25 is located near intermediate wall 18, discharge opening 27 being further away from intermediate wall 18 than suction opening 25.

Modular block 10 further has one or several reinforcing ribs 26 and/or one or several radial partitions 28.

Each reinforcing rib 26 connects inner side wall 17 to intermediate wall 18.

Each radial partition 28 connects the or one of outer side walls 16 and inner side wall 17 over the entire height of main body 12. Radial partition 28 thus extends on either side of intermediate wall 18.

Alternatively, main body 12 does not include an intermediate wall 18 as previously described, but another arrangement defining at least one volume able to be adapted to form a fluid reservoir. Main body 12 for example includes a first half-bottom and a second half-bottom. The first half-bottom extends at a first end of the main body in elevation direction Z in first half $E_1$ of the space. The second half-bottom extends at a second end of the main body in elevation direction Z, opposite the first end, in second half $E_2$ of the space.

Main body 12 further defines a housing 30, the housing being provided to receive pumping device 14.

Housing 30 is arranged between inner side wall 17 and the or one of outer side walls 16.

Housing 30 extends away from contact location 21 between inner side wall 17 and outer side wall(s) 16 in longitudinal direction X.

Housing 30 extends along a main axis Δ included in first plane $P_h$. More specifically, housing 30 has an end, denoted proximal end, located in the vicinity of through-orifice 20 and an end, denoted distal end, opposite the proximal end in the direction of the main axis Δ.

Main axis Δ of housing 30 within housing 30 extends on one side of second plane $P_v$, more specifically in the example of FIG. 1 on first side $E_1$.

Main axis Δ of housing 30 within housing 30 extends outside second plane $P_v$, that is to say, the point forming the intersection between main axis Δ and second plane $P_v$ is located outside the housing.

The intersection between main axis Δ and second plane $P_v$ is more particularly located in through-orifice 20, more specifically at central axis D of through-orifice 20.

Housing 30 emerges in through-orifice 20 on the one hand and outside main body 12 on the other hand.

Housing 30 has an orthogonal symmetry relative to first plane $P_h$.

Main axis Δ of housing 30 defines an angle α with second plane $P_v$.

The distance in transverse direction Y of main axis Δ within housing 30 at second plane $P_v$ is strictly increasing from the proximal end toward the distal end.

Housing 30 here is delimited by a hollow cylinder having the main axis Δ as axis of rotation.

Figure 2:
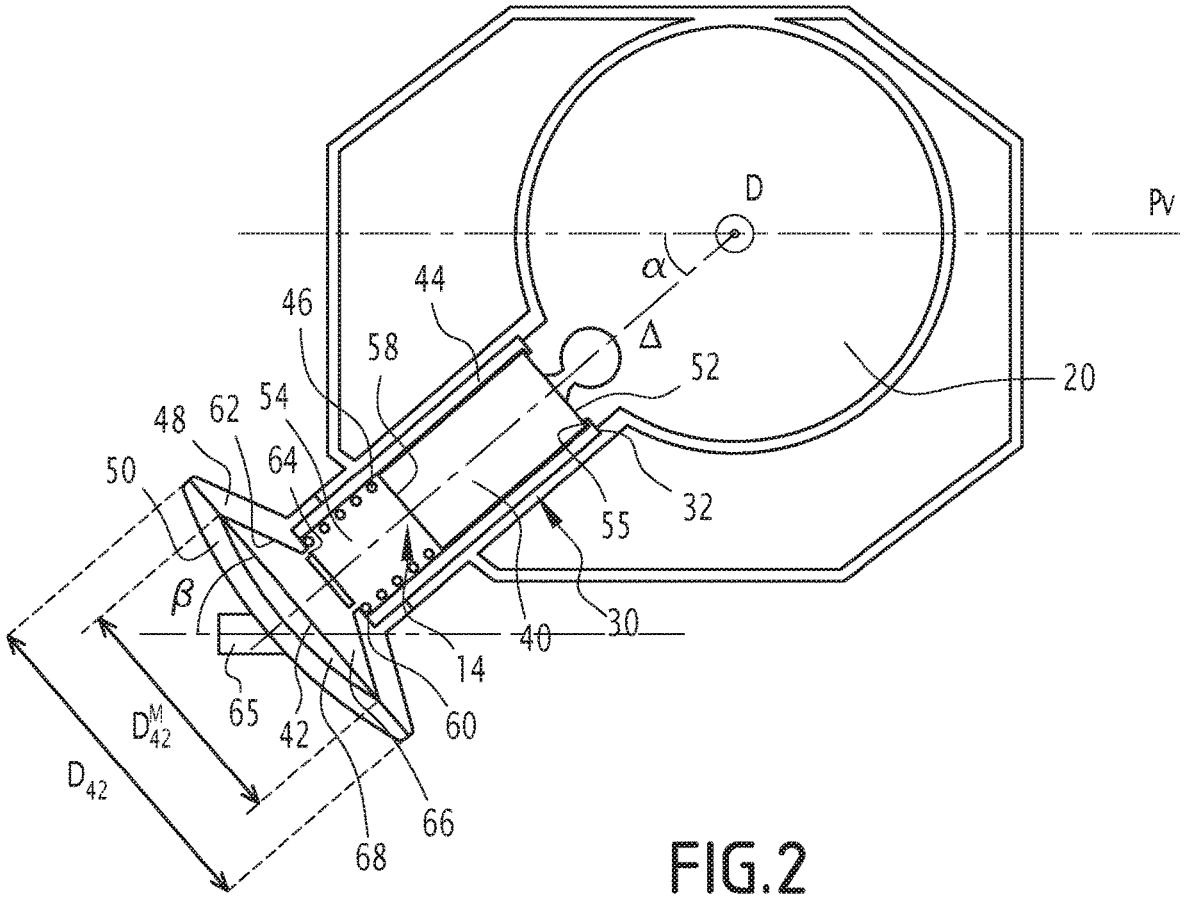
FIG. 2 is a modular block diagram of the pumping device of a modular block of FIG. 1.

Housing 30 has a shoulder 32 visible in FIG. 2 near through-orifice 20.

Main body 12 as a whole has an orthogonal symmetry relative to first plane $P_h$.

Main body 12 has a reversibility by rotation around the reversion axis δ by a given angle, here called reversion angle. The reversion angle is equal to 180°. This will be described in more detail hereinafter in light of operation of the modular block.

Main body 12 here has a height $h_{12}$ equal to 120 millimeters.

Main body 12 is, for example, made from aluminum or stainless steel.

Pumping device 14 extends partially in housing 30 of main body 12.

Pumping device 14 has an orthogonal symmetry relative to first plane $P_h$.

Pumping device 14 extends outside second plane $P_v$.

In the illustrated example and as shown in FIG. 2, pumping device 14 includes a piston 40 and a diaphragm 42.

Piston 40 extends at least partially in housing 30.

Diaphragm 42 extends outside housing 30 on an opposite side in regard to, or away from, through-orifice 20.

Diaphragm 42 extends outside the general shape of main body 12.

Pumping device 14 further includes a sleeve 44 in which piston 40 and/or a return member 46 of piston 40 moves.

Pumping device 14 further includes a base 48 for diaphragm 42 and/or a closing wall 50. Diaphragm 42 extends between base 48 and closing wall 50.

Sleeve 44 and, if applicable, base 48 and closing wall 50 are, for example, made from aluminum and/or stainless steel.

Sleeve 44 extends at least partially in housing 30.

Sleeve 44 extends between a proximal end on the side of through-orifice 20 and a distal end on the side of diaphragm 42.

The proximal end of sleeve 44 bears against shoulder 32 of housing 30.

In the illustrated example, sleeve 44 extends partially outside housing 30. More specifically, the distal end of sleeve 44 extends outside housing 30.

Sleeve 44 delimits an inner volume.

Sleeve 44 is a hollow cylinder, the axis of the cylinder advantageously being combined with main axis Δ.

The outer diameter of sleeve 44 is substantially equal to the diameter of the cylinder forming housing 30.

Sleeve 44 forms a lining of the orifice forming housing 30.

The piston extends fully in sleeve 44 and at least partially in housing 30.

Sleeve 44 cooperates with piston 40 such that piston 40 is able to slide in sleeve 44, sleeve 44 forming the complementary cylinder of piston 40.

Piston 40 is able to slide in translation in sleeve 44 in the direction of main axis Δ.

Piston 40 separates the inner volume of sleeve 44 into a proximal chamber 52 on the side of through-orifice 20 and a distal chamber 54 on the side of diaphragm 42.

Distal chamber 54 contains a transmission fluid.

Piston 40 is translatable between two extreme positions: a so-called suction position shown in FIG. 2 and a so-called expulsion position.

The volume of distal chamber 54 in the suction position is strictly greater than the volume of distal chamber 54 in the expulsion position of a given displacement, for example, between 50 cL and 500 cL.

In the illustrated example, in the suction position visible in FIG. 2, piston 40 is substantially flush with sleeve 44 on the side of through-orifice 20, more specifically here bears against an end shoulder 55 of sleeve 44.

In the expulsion position, the piston is substantially flush with sleeve 44 on the side of diaphragm 42.

Return member 46 of piston 40 is arranged to return piston 40 to the suction position.

Return member 46 here is a spring working in extension.

Return member 46 extends between a bearing surface 58 of piston 40 and a shoulder 60 formed at the distal end of sleeve 44.

More specifically, shoulder 60 is formed by base 48.

Base 48 extends adjacent to sleeve 44 at the distal end of sleeve 44.

Base 48 has a support surface 62 for diaphragm 42.

Support surface 62 is arranged on base 48 opposite sleeve 44 in the direction of the main axis Δ of housing 30.

Support surface 62 is curved and concave.

Support surface 62 has a continuous symmetry of rotation around main axis Δ.

Support surface 62 is generally in the shape of a bowl.

A central part of support surface 62 extends against the distal end of sleeve 44.

Support surface 62 further includes a peripheral part surrounding the central part.

Base 48 has a plurality of through-openings 64 between the inner volume of sleeve 44 and support surface 62.

The peripheral part of support surface 62 is devoid of opening.

Base 48 here is fastened on main body 12.

Closing wall 50 extends facing base 48 along main axis Δ.

It has a curve in the inverse direction of the base.

Base 48 and closing wall 50 delimit a volume between them, here in the form of a spindle.

Closing wall 50 has two openings 65, called connection openings, allowing fluid to enter and/or exit through the closing wall. More specifically, one of the openings, called inlet opening, allows fluid to enter, while the other of the openings, called outlet opening, allows fluid to exit.

Closing wall 50 outside connection openings 65 has a continuous symmetry of rotation around main axis Δ.

Each opening 65 here extends parallel to first plane $P_h$.

Each opening 65 here extends parallel to second plane $P_v$. More specifically, each opening 65 defines an angle β with main axis Δ of housing 30, angle β being in addition to the angle α defined between main axis Δ of housing 30 and second plane $P_v$.

In particular, this makes it possible to connect pipes extending in longitudinal direction X without needing an additional elbow part, to facilitate operation of the piping system for an operator, and to limit the space requirement of the modular block with its piping system along transverse axis Y.

Each connection opening 65 has a valve system (not shown) to respectively be able to regulate the entry or exit of fluid through the opening.

Each valve system is able to close off the opening in a closed position.

Each valve system includes a system for returning the valve to the closed position. The return system is, for example, mechanical using a spring and/or magnet and/or electromagnet.

The valve system is able to allow the passage of fluid through the opening in the desired direction when a pressure force corresponding to the desired direction and exceeding a given force is established on the valve system.

Advantageously, such a valve system including a return system does not require a particular orientation, the latter in particular not working by gravity.

Diaphragm 42 extends between base 48 and closing wall 50, more specifically in the volume delimited between base 48 and closing wall 50.

Diaphragm 42 is fastened on its periphery to the peripheral part of base 48 and the peripheral part of closing wall 50.

Diaphragm 42, as well as base 48 and closing wall 50, extend on first side $E_1$ of second plane $P_v$, outside of second plane $P_v$.

Diaphragm 42 is hermetic.

It hermetically separates the space between base 48 and closing wall 50 between a volume 66 fluidly communicating with distal chamber 54 and an outer volume 68.

Connection openings 65 fluidly communicate with outer volume 68.

Diaphragm 42 is able to deform under a pressure difference between communicating volume 66 and outer volume 68.

When the pressure of communicating volume 66 is equal to that of outer volume 68, called iso-pressure case, the diaphragm for example extends substantially along a plane parallel to elevation direction Z.

When piston 40 is in the suction position, the pressure in the distal chamber decreases and the diaphragm deforms such that communicating volume 66 decreases and outer volume 68 increases relative to the iso-pressure case.

The valve systems closing the connection openings by default, the pressure of outer volume 68 decreases. This causes the valve system of the inlet opening to open, and fluid penetrates outer volume 68.

When piston 40 is in the expulsion position, the pressure in the distal chamber increases and the diaphragm deforms such that communicating volume 66 increases and outer volume 68 decreases relative to the iso-pressure case.

The valve systems closing the connection openings by default, the pressure of outer volume 68 increases. This causes the valve system of the outlet opening to open, and fluid is expelled from outer volume 68.

Diaphragm 42 has a size in elevation direction Z strictly larger than that of main body 12.

Nondeformed diaphragm 42 here is a disc, the central axis of which is main axis Δ.

Diaphragm 42 here has a diameter $D_{42}$ strictly greater than 120 millimeters, more specifically greater than or equal to 250 millimeters.

Diaphragm 42 further has a diameter, called wet diameter, $D^{M}_{42}$, greater than or equal to 100 millimeters, more specifically greater than or equal to 150 millimeters. "Wet diameter" refers to the diameter of the diaphragm in contact with communicating volume 66 and outer volume 68. The wet diameter corresponds to the diameter of the surface, that is deformable, of the diaphragm.

Angle α between main axis Δ of the housing and second plane $P_v$ is chosen such that the diaphragm extends entirely outside second plane $P_v$. In particular, angle α notably depends on the diameter of the diaphragm and the distance from the diaphragm to through-orifice 20.

Angle α is for example greater than or equal to 20°.

The fact that diaphragm 42 extends outside the general shape of main body 12 thus makes it possible to reduce the size in elevation direction Z of main body 12 to a smaller size than if diaphragm 42 were to extend inside main body 12.

Each module block has a reversibility by rotation around reversion axis δ, that is to say, the module block can be used in a first configuration and in a second configuration, the modular block having undergone a rotation by a given angle around reversion axis δ, between the first configuration and the second configuration. The given angle, called reversion angle, here is equal to 180°. More specifically here, it suffices to change the system for piping and connection to the modular block to make the modular block usable in one or the other of the configurations.

Each functional part of the modular block is either common and usable in both configurations, like the pumping device, or is present in duplicate, like, in the illustrated case, the open volume with the corresponding openings.

In particular, main body 12, base 48 for diaphragm 42 and closing wall 50 are reversible relative to reversion axis δ.

An exemplary method for manufacturing a module block will now be described in light of FIGS. 1 and 2.

The manufacturing method includes the following steps:

providing, for example by machining or extrusion, a main body 12 as previously described, and placing a pumping device 14 in housing 30 of the main body.

The pumping device is off-centered relative to second plane $P_v$, of the main body.

An exemplary electric pump 100 for a fluid product according to the invention will now be described in light of FIG. 3.

The pump is sized to work up to a pressure of 30 bars.

Pump 100 includes an electric motor 102 and at least two modular blocks 104, 106 as previously described.

More specifically here, pump 100 includes two modular blocks 104, 106.

Modular blocks 104, 106 are identical, that is to say, they are formed on the same model with the same dimensions.

They are superimposed such that their general shapes are superimposed in their respective elevation directions Z.

Respective elevation directions Z of the different modular blocks are combined.

The outer and inner side walls of the different modular blocks are aligned in elevation direction Z.

In the illustrated example, elevation direction Z is substantially parallel to the direction of the local gravity.

Alternatively, elevation direction Z is for example perpendicular to the direction of the local gravity. Joints are advantageously provided between the modular blocks.

Respective second planes of modular blocks 104, 106 are combined into a common second plane $P_v$.

Respective first planes of modular blocks 104, 106 are parallel to one another.

Respective main axes $\Delta_1$, $\Delta_2$ of modular blocks 104, 106 within the respective housings are placed alternating on a first side 108 and a second side 110 of second common plane $P_v$.

More specifically here, main axis $\Delta_1$ of a first modular block 104 in the corresponding housing is placed on first side 108 of second plane $P_v$, and main axis $\Delta_2$ of second modular block 106 in the corresponding housing is placed on second side 110 of second plane $P_v$.

The diaphragms of the respective pumping devices of modular blocks 104, 106 are placed alternating on first side 108 or on second side 110 of the second common plane $P_v$.

The diaphragms are arranged in staggered rows on either side of second common plane $P_v$.

Each module block is turned over relative to the adjacent module block(s) along corresponding reversion axis δ.

Each module block is suitable for operating according to its arrangement within the pump.

More specifically, each modular block is able to be connected at connection openings of a fluid product circulation circuit.

The various connectors and pipes connected to each module or block are adapted to the given arrangement.

For each modular block, the valve systems of the connection openings are arranged so that lower opening 112, 114 in elevation direction Z is the inlet opening, and upper opening 116, 118 is the outlet opening.

This advantageously makes it possible to drive out the air that may be present in the outer volume of said modular block and that may decrease the pumping efficiency of the pumping device.

For each modular block corresponding to the example described in light of FIG. 1, the open volume of the half located above the intermediate wall in elevation direction Z here serves as base reservoir and is connected to the communication volume. The open volume of the upper half, for example, contains the same transmission fluid contained in the communication volume, so as to be able to supply fluid to the communication volume on the one hand and to allow the expulsion of the fluid from the communication volume.

The suction opening and the discharge opening of the corresponding open volume are connected to the communication volume by means of connectors and pipes. The suction opening and the discharge opening of the other open volume are plugged.

More specifically, the pump here includes, for each modular block, a suction connector 120, 122 including an orifice and a stopper, the orifice being provided to be placed facing the suction opening of the reservoir and the stopper facing the suction opening of the other open volume.

The pump further includes, for each modular block, a discharge connector 124, 126 connected to the discharge opening of the reservoir and a stopper 128, 130 provided to close the discharge opening of the other open volume.

As previously described, alternatively, one or several reservoirs are formed by a volume arranged differently than in the illustrated example. When each modular block includes two half-bottoms as previously described, the reservoir extends, for example, over the height of two modular blocks, suction and discharge openings being provided on each half.

Each reservoir for example has a volume greater than or equal to the maximum volume of transmission fluid to fill all of the space containing transmission fluid, such as the communicating volume and the displacement.

The reservoir or set of reservoirs has a reversibility by rotation around reversion axis δ by the reversion angle.

Figure 4:
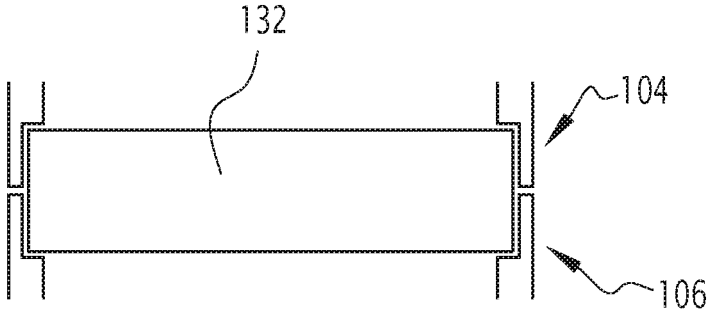
FIG. 4 is a schematic view of an exemplary rolling bearing between two modular blocks according to the invention.

Pump 100 further includes a bearing 132, particularly rolling bearing, at each interface between two adjacent modular blocks 104, 106, as shown in FIG. 4.

Bearing 132 extends straddling the two modular blocks.

The bore of each modular block at one end of the through-orifice is complementary to the half of the bearing, the bearing being arranged in a bore of each of the modular blocks at the interface.

Pump 100 further includes a lower plate 134 and an upper plate 136, arranged on each side of the superposition of modular blocks 104, 106, in elevation direction Z.

Lower plate 134 and upper plate 136 have a shape generally able to be superimposed with that of the modular blocks.

Lower plate 134 and upper plate 136 close pump 100 on either side of modular blocks 104, 106.

Pump 100 includes a shaft (not shown) extending in elevation direction Z through the through-orifices of modular blocks 104, 106 and rotatable around elevation direction Z by electric motor 102.

The pump further includes, for each modular block, a means for transmitting the rotational movement of the shaft into a translational movement at the modular block in the elevation direction.

The transmission means, for example, includes a connecting rod and crank system, an eccentric or a cam.

The transmission means is secured to the shaft in rotation about elevation direction Z on the one hand and provided to interact with the pumping device of the modular block on the other hand.

More specifically, the transmission means is provided to move the piston between the suction position and the expulsion position, then conversely, by rotating the shaft in a same operating direction of the motor.

The operation of the pump shown in FIG. 3 will now be described.

Inlet opening 112, 114 and outlet opening 116, 118 of each modular block 104, 106 are connected to a fluid product circulation circuit, the outlet opening being provided to expel fluid product at a given flow rate in the circulation circuit and the inlet opening to suction the fluid product.

In a first embodiment, modular blocks 104, 106 are connected to a same fluid product circulation circuit, so as to multiply the flow rate in the circulation circuit.

In a second embodiment, modular blocks 104, 106 are connected to separate fluid product circulation circuits, for example, containing different fluid products.

Alternatively, certain modular blocks are connected to a same fluid product circulation circuit, and at least one of the modular blocks is connected to a separate circulation circuit.

Electric motor 102 rotates the shaft of the pump around elevation direction Z, more specifically at a constant rotation speed.

The piston of each modular block is moved via the transmission means between the suction position and the expulsion position, then vice versa.

As previously explained, this causes a suction of fluid product through the inlet opening, then an expulsion of fluid product through the outlet opening.

For each modular block, in each cycle, the pump suctions and discharges, for this modular block, a given volume of fluid product, here corresponding to the displacement of the associated pumping device.

Figure 5:
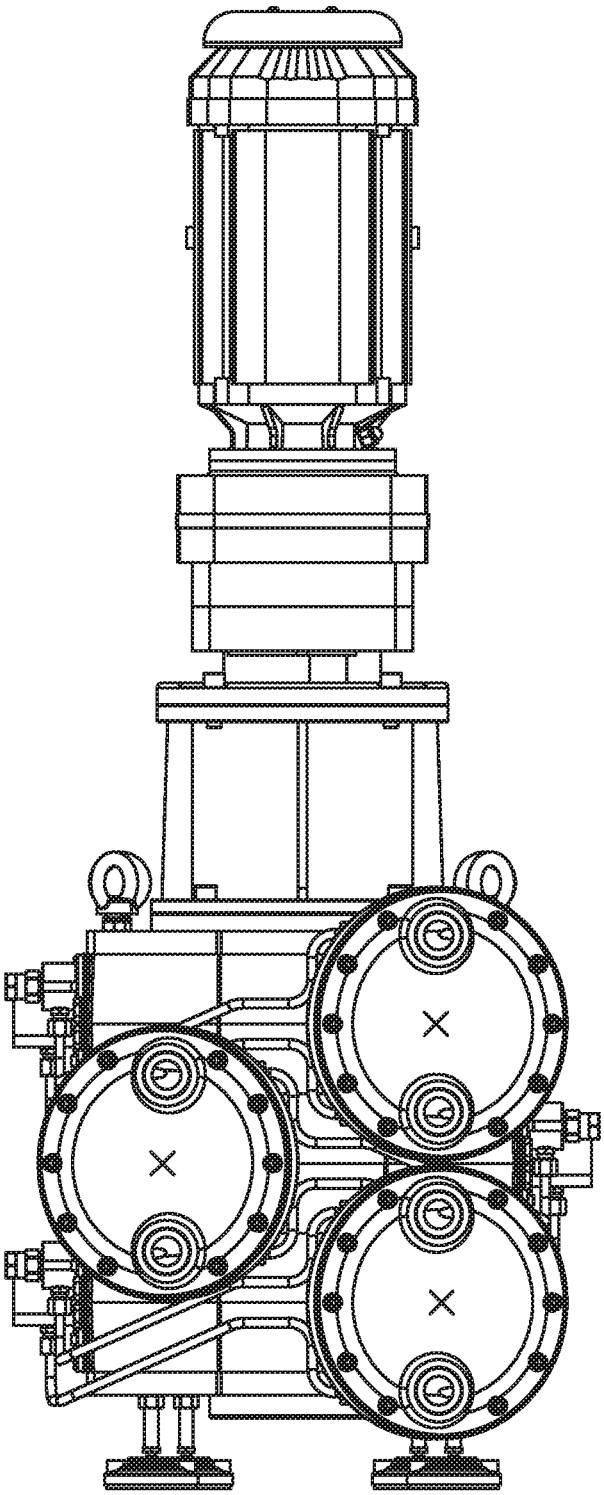
FIGS. 5 and 6 are front views of an electric pump respectively including three and five modular blocks according to variants of the invention.
Figure 6:
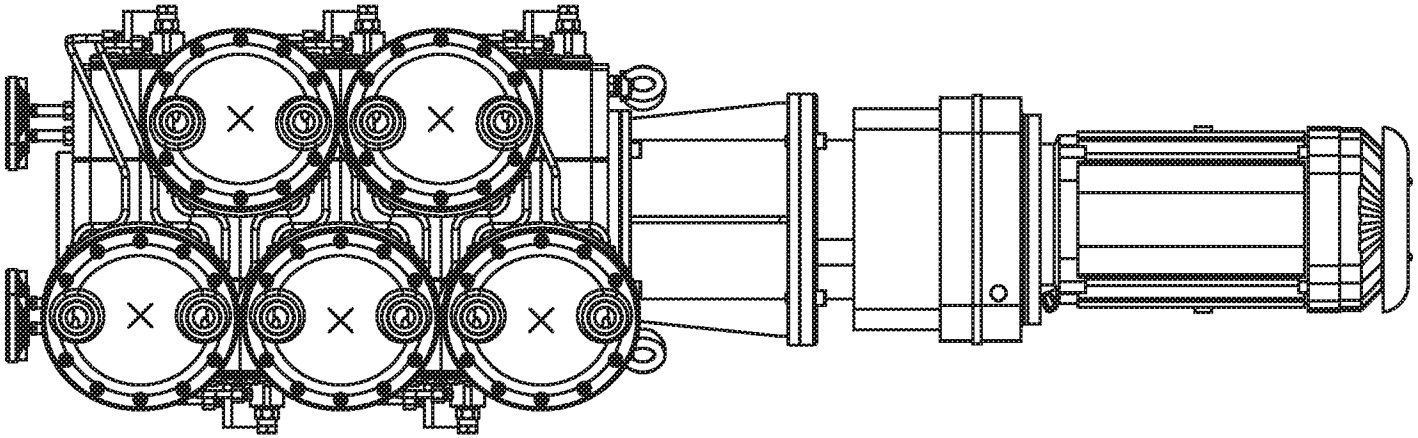

Second and third examples of an electric pump for a fluid product according to the invention are shown in FIGS. 5 and 6.

Figure 3:
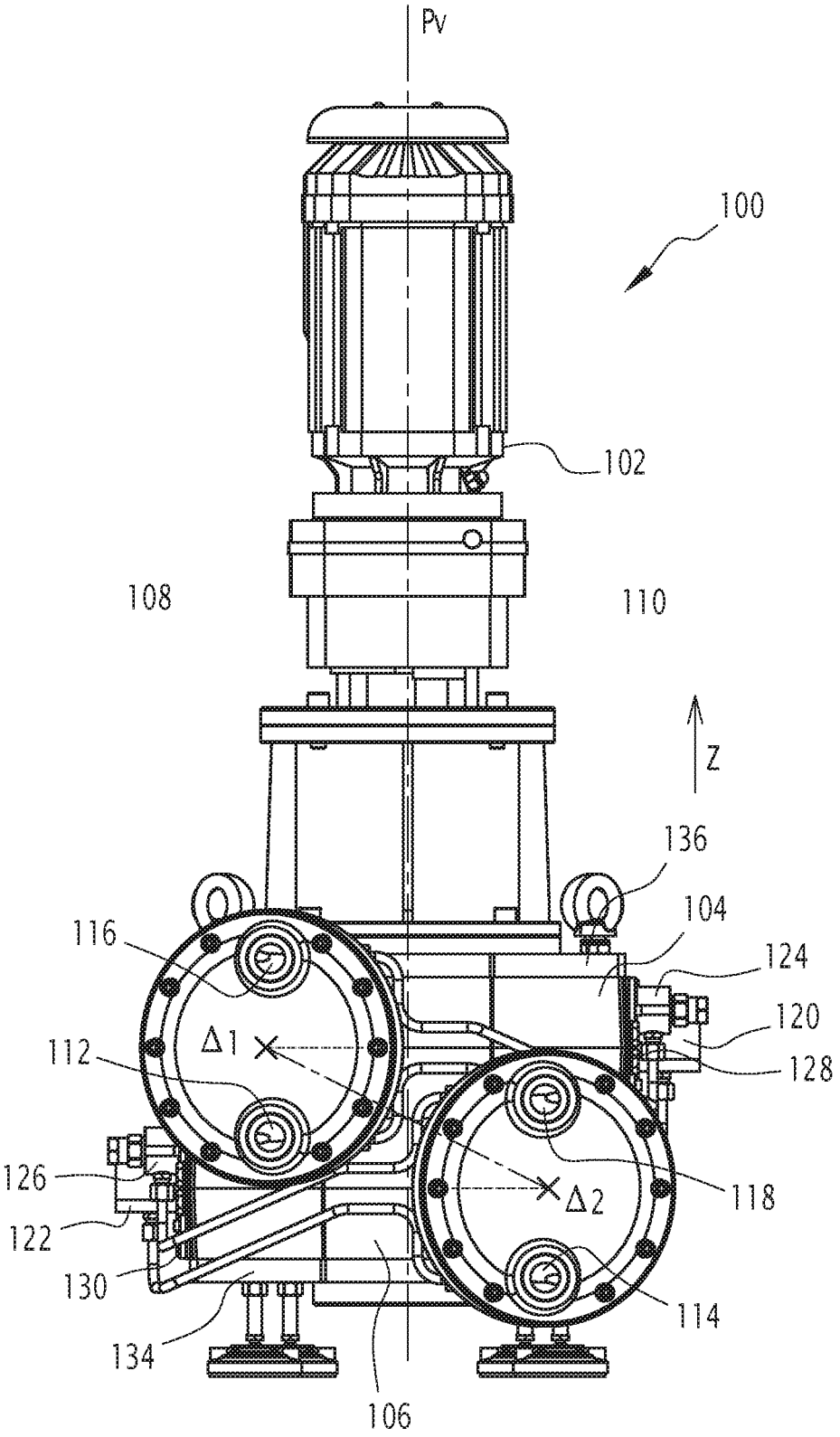
FIG. 3 is a front view of an electric pump including two modular blocks according to one embodiment of the invention.

These pumps only differ from the pump shown in FIG. 3 in terms of the number of modular blocks, the second example showing three modular blocks and the third example showing five modular blocks.

The modular blocks are placed similarly to the example of FIG. 3, that is to say, they are superimposed such that the main axes are placed alternating on one side or the other of the combined second planes.

The addition or removal of modular blocks makes it possible to adjust the displacement of the pump and thus the flow rate in a same product circulation circuit by multiplying the flow rate corresponding to a modular block.

Alternatively or additionally, the addition of modular blocks makes it possible to control the flow rate of different products by changing the number of circulation circuits of different products to which the pump is connected.

Such a pump is therefore easily adaptable to different flow rate ranges by adding or removing modular blocks, without needing to change the motor.

Furthermore, the use of modular blocks that are identical to one another reduces the number of part models needed to produce a pump. This makes it possible to reduce the costs associated with manufacturing such a pump.

Furthermore, such a pump has a reduced footprint due to the stacking of the modular blocks in elevation direction Z.

Such a pump further has a reduced space requirement in elevation direction Z due to the fact that the pumping devices are arranged alternating on one side or the other of the second plane, which is in particular possible owing to the orthogonal symmetry relative to their first respective plane of each modular block.

The diaphragm here has a significant bulk in elevation direction Z. Indeed, the greater the displacement of the piston of the pumping device is, the higher the center of the diaphragm is upon each cycle with an equal diameter of the diaphragm, which causes wearing of the diaphragm. To limit wearing of the diaphragm, it is advantageous to decrease the ratio of travel at the center of the diaphragm to the wet diameter of the diaphragm.

To limit travel at the center of the diaphragm, a diaphragm with a large diameter is used. Thus, for a given displacement, that is to say, a given displaced volume, travel at the center is strictly less for a diaphragm of larger diameter. Here, "diaphragm of large diameter" refers to a diaphragm having a so-called wet diameter greater than or equal to 100 mm.

The alternating of the sides of the diaphragms makes it possible to have a main body for each modular block having a dimension in elevation direction Z strictly smaller than that of the corresponding diaphragm.

More specifically, the dimension in elevation direction Z of the main body is equal to the outer diameter of the diaphragm divided by 2, increased by a superposition play of the diaphragms on one side. The play is, for example, between one millimeter and ten millimeters.

The superposition of three modular blocks according to the invention thus has substantially the same space requirement in the elevation direction Z as the superposition of two modular blocks in which the pumping devices are superimposed.

Generally, the superposition of five modular blocks according to the invention has substantially the same space requirement in the elevation direction Z as the superposition of three modular blocks in which the pumping devices are superimposed.

The invention has been described and illustrated in the context of a pumping device including a diaphragm. However, the invention is adaptable to a modular block including a different pumping device, in particular including a piston and devoid of a diaphragm.

Such a modular block does not, for example, delimit a volume able to be used as a transmission fluid reservoir.

This in particular makes it possible to make the main body with a size in elevation direction Z strictly smaller than that of the pumping device, irrespective of the nature of the pumping device.

Each main body thus has a smaller size in elevation direction Z relative to the case where the main body is sized such that the pumping devices are superimposed on one another.

The superposition of the modular blocks on one another then has a smaller bulk in elevation direction Z.

The invention claimed is:

1. A modular block for an electric pump for a fluid product, comprising:

a main body defining a housing extending along a main axis, the main body having a general shape having a discrete rotational symmetry relative to a reversion axis, the main axis of the housing within the housing extending on a first side of a central plane outside the central plane, the reversion axis being included in the central plane, and the main body delimiting at least one fluid reservoir, the at least one fluid reservoir being formed by at least one open volume, each of the at least one open volume having a suction opening and a discharge opening, the at least one fluid reservoir being reversible by rotation relative to the reversion axis, such that the modular block is usable in a first configuration and a second configuration wherein the modular block undergoes a rotation around the reversion axis between the first and second configurations; and a pumping device extending at least partially in said housing of said main body, wherein the modular block in the first configuration is adapted to be superimposed such that the modular block in the first configuration abuts with an identical modular block in the second configuration.

2. The modular block according to claim 1, wherein the general shape of said main body has an orthogonal symmetry relative to the central plane.

3. The modular block according to claim 1, wherein said main body comprises an intermediate wall, the intermediate wall delimiting two open volumes forming the at least one fluid reservoir.

4. The modular block according to claim 1, wherein said pumping device comprises a diaphragm, the diaphragm extending on the first side of the central plane outside the central plane.

5. The modular block according to claim 4, wherein said pumping device comprises a piston, the piston extending at least partially in said housing and being able to slide along the main axis of said housing.

6. The modular block according to claim 1, wherein the main axis extends in a first plane, the first plane being perpendicular to the central plane, the reversion axis being included in the first plane.

7. The modular block according to claim 6, wherein said main body comprises a through-orifice that passes completely through said main body, in a direction perpendicular to the first plane, denoted as an elevation direction, the through-orifice having an orthogonal symmetry relative to the first plane and relative to the central plane, said housing emerging in the through-orifice.

8. The modular block according to claim 7, wherein said through-orifice has a central axis along the elevation direction, an intersection between the main axis and the central plane being included in the central axis.

9. The modular block according to claim 7, wherein said pumping device comprises a diaphragm, the diaphragm extending on the first side of the central plane outside the central plane, the diaphragm being arranged outside said housing away from said through-orifice along the main axis of said housing.

10. An electric pump for a fluid product comprising:

an electric motor; and at least two modular blocks, wherein each modular block of the at least two modular blocks is according to claim 1, the at least two modular blocks being identical and placed side by side such that their general shapes are superimposed in an elevation direction, their respective central planes are combined in a common central plane, the at least two modular blocks being placed such that their main axes are placed alternating on a first side and a second side of the common central plane.

11. The electric pump according to claim 10, wherein the main body of each modular block of the at least two modular blocks comprises an intermediate wall, the intermediate wall delimiting two open volumes forming the at least one fluid reservoir, and wherein the electric pump further comprises, for each modular block of the at least two modular blocks, a suction connector comprising:

an orifice to be placed facing the suction opening of one of the two open volumes; and a stopper facing the suction opening of the other of the two open volumes.

12. The electric pump according to claim 10, wherein the at least two modular blocks are formed on the same model with the same dimensions.

13. The electric pump according to claim 10, wherein the pumping devices of the at least two modular blocks are arranged in staggered rows on either side of the common central plane.

* * * * *